United States Patent [19]

Klysz

[11] 4,252,463

[45] Feb. 24, 1981

[54] TUNNEL DRIVING APPARATUS

[75] Inventor: Edwin Klysz, Lunen, Fed. Rep. of Germany

[73] Assignee: Gewerkschaft Eisenhutte Westfalia, Lunen, Fed. Rep. of Germany

[21] Appl. No.: 4,129

[22] Filed: Jan. 17, 1979

[30] Foreign Application Priority Data

Jan. 30, 1978 [DE] Fed. Rep. of Germany ..... 2803890

[51] Int. Cl.[3] ..... E01G 3/00

[52] U.S. Cl. ..... 405/142; 405/145

[58] Field of Search ..... 405/145, 143, 139, 142; 175/61, 73, 74, 76; 299/31

[56] References Cited

U.S. PATENT DOCUMENTS

| | | | |
|---|---|---|---|
| 3,415,329 | 12/1968 | Marlind | 175/61 X |
| 3,630,574 | 12/1971 | Cox | 175/76 X |
| 3,926,005 | 12/1975 | Foik | 405/145 X |
| 4,121,673 | 10/1978 | Cherrington | 175/61 |

FOREIGN PATENT DOCUMENTS

| | | | |
|---|---|---|---|
| 1207906 | 12/1965 | Fed. Rep. of Germany | 175/73 |
| 2555524 | 6/1977 | Fed. Rep. of Germany . | |
| 231983 | 7/1969 | U.S.S.R. | 175/74 |

*Primary Examiner*—Dennis L. Taylor

*Attorney, Agent, or Firm*—Sughrue, Rothwell, Mion, Zinn and Macpeak

[57] ABSTRACT

A drive shield of a tunnelling apparatus employs composite drive members or poling plates supported and guided for advancement in the driving direction on a frame. Each drive member has a front part pivotably connected to a rear part. The connection between the front and rear parts of each drive member is additionally designed to enable the rear part to be positionally adjusted as a whole in relation to the front part to bring their outer surfaces defining and supporting the tunnel wall, into exact alignment.

15 Claims, 5 Drawing Figures

TUNNEL DRIVING APPARATUS

BACKGROUND TO THE INVENTION

The present invention relates to shield apparatus for driving tunnels, galleries or similar excavations; and more particularly, to drive members or poling plates therefor.

It is known to construct shield apparatus from a plurality of poling plates or drive members arranged side-by-side forming a shield supported and guided on a frame. The drive members contact the tunnel wall being produced and are advanced individually or in groups in the driving direction by means of rams connected between the drive members and the support frame. It is also known to make the individual drive members from pivotably-interconnected front and rear parts. Such a construction is described in German Pat. Specification No. 2,555,524. The pivotal connections between the front and rear parts or components of the drive members impart a certain flexibility to the shield and permit the shield to adapt to deviations in the tunnel path. This is particularly useful where the tunnel takes a slightly curvilinear course since the tunnel wall can then exert extreme forces on the drive member, especially the rear regions thereof.

Although shield apparatus employing such pivotable drive members has performed well, the one drawback of this design is that the pivot connection and the front and rear components of each drive member needs to be constructed within close tolerances to ensure that the outer surfaces of the components, which define and support a region of the tunnel wall, can be aligned with one another. If such alignment is not achieved, one or other of the components may not quite contact the tunnel wall and the other component will then encounter greater driving resistance and loading. Furthermore, settlements can be caused over the unsupported tunnel wall region. Naturally, the fabrication of drive member components, usually from sheet steel, and the pivot connections within close tolerances considerably increases the overall cost of the shield apparatus.

An object of the present invention is to provide an improved drive member and shield apparatus.

SUMMARY OF THE INVENTION

Briefly stated, the invention provides adjustable connection means between the front and rear parts or components of a drive member for a shield which, in contrast to the simple known pivot joint, permits the parts to be relatively adjusted as a whole transversally of the tunnel wall to bring their outer surfaces into alignment. The drive member parts or connection devices need not be manufactured to close tolerances since the aforementioned adjustment makes this unnecessary. The invention can be applied to the known form of pivot connection between the parts which enables the rear part to be swung about the front part radially in or out relative to the tunnel axis. In this case, the adjustable connection means may include an eccentric element, such as a rotatable spindle with radially offset portions locating to the front and rear drive member parts. The eccentric element may then effect the pivot connection between the parts while part rotation of the element serves for the adjustment. It may be desirable to disable the adjustment once the correct alignment has been established and in accordance with a further feature of the invention a locking means can hold the element in its set position.

The invention can also be applied to other forms of connection between the drive member parts. For example, the invention can be applied to a connection which permits pivoting about an axis radial or transverse to the tunnel wall. In this case, the adjustment can be accomplished to fitting or removing spacers to alter the position of a stop surface against which one of the drive member parts or a projection thereof engages. Preference may be given to a design where a projection of, say, the rear part locates in a recess within the front part and a plate adjustably secured to the front part with means including the spacers, defines the stop face for the projection. Alternatively, the spacers may otherwise be used to alter the size of the recess.

The invention may be understood more readily and various other features of the invention may become apparent from consideration of the following description.

BRIEF DESCRIPTION OF DRAWING

Embodiments of the invention will now be described, by way of examples only, with reference to the accompanying drawing, wherein.

DESCRIPTION OF PREFERRED EMBODIMENTS

Figure 1:
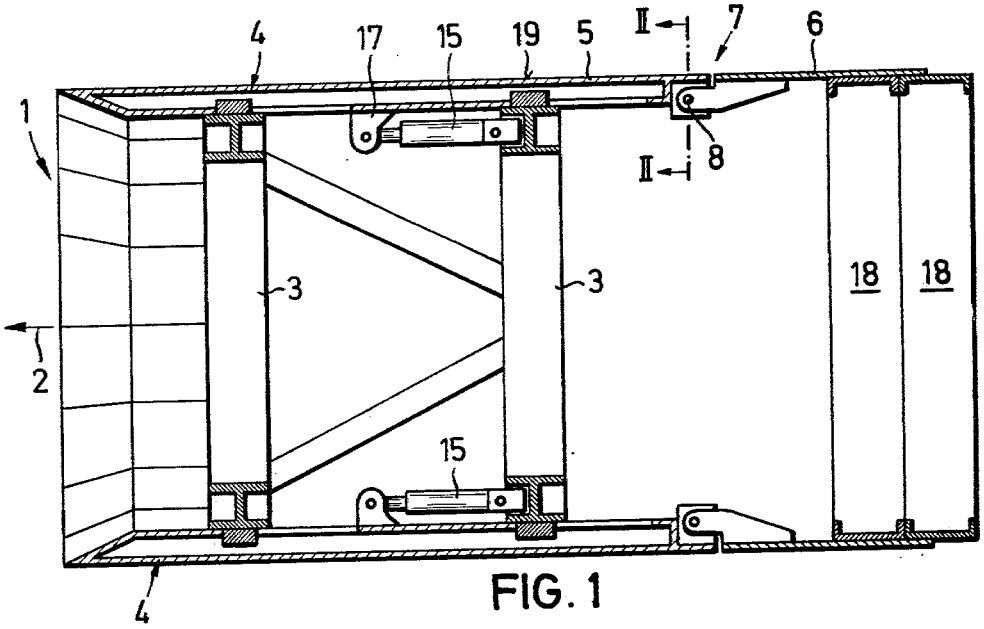
FIG. 1 is a schematic sectional side view of shield apparatus employing drive members constructed in accordance with the invention.

As shown in FIG. 1, shield apparatus employs a plurality of steel drive members or poling plates 4 arranged side-by-side in a circular array and carried by a frame 3. The members 4 are individually displaceable in their longitudinal direction to advance the tunnel or similar excavation in the driving direction 2. The forward ends of the members 4 relative to the driving direction 2 are tapered to form a sharp cutting edge 1.

The members 4 are guided for longitudinal displacement and double-acting hydraulic rams 15 are connected between brackets 17 of the members 4 and a rear part of the frame 3. When extended, the rams 15 serve to selectively advance the members 4. By operating the rams 3 in unison in the retraction sense the frame 3 can be drawn up to follow the driving progress.

Each drive member 4 is composed of two parts; namely a forward part 5 and a rear part 6. The forward part 5 of each drive member 4 is of hollow box-like form while the rear part 6 is of a unitary plate-like form. The external faces of the parts 5,6 of the drive members 4 collectively define the external surface 19 of the shield. The parts 5,6 of each drive member 4 are interconnected by means of a connecting device 7. The rear end regions of the drive member rear parts 6 are supported on tubbings 18 or the like, which are installed from the rear of the shield apparatus to support the tunnel wall exposed as the driving work progresses. Each connecting device 7 includes an eccentric element 8 which can be partly rotated to alter the relative position of the associated parts 5,6. The element 8 also constitutes a pivot joint between the parts 5,6.

Figure 2:
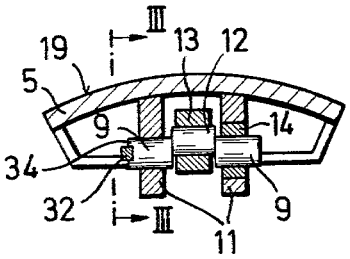
FIG. 2 is a sectional end view of part of the shield apparatus, the view being taken along the line II—II of FIG. 1.
Figure 3:
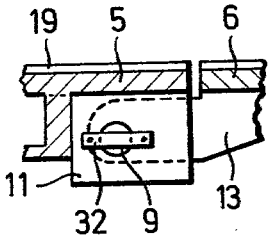
FIG. 3 is a sectional side view of the part of the shield apparatus, the view being taken along the line III—III of FIG. 2.

As shown in FIGS. 2 and 3, the eccentric element 8 of each device 7, takes the form of a shaft or spindle with concentric outer portions 9 and a radially offset eccentric central portion 12. The portions 9 extend through webs 11 formed or attached as by welding to the inner face of the front part 5 of the associated drive member 4. The central portion 12 extends through a similar web 13 formed or attached as by welding to the inner face of the rear part 6 of the associated drive member 4. The web 13 extends between the webs 11. To enable the element 8 to be readily fitted or disengaged, one of the webs 11 has a removal fitting piece 14 detachably secured with any suitable means to the main body of the web 11. During operation of the shield apparatus to advance the tunnel or other excavation, the elements 8 of the respective drive members 4 can be adjusted., i.e. partly rotated, to bring the outer external faces of the parts 5,6 into exact alignment. To lock the elements 8 in position after such adjustment, locking members in the form of rods 32 are used. As shown, each rod 32 is located in a groove 34 of an associated end portion 9 of the element 8 in question. The rod 32 is secured to the outer face of the associated web 11 with the aid of screws or bolts and thus locks the element 8 in the desired rotational position. The web 11 to which the rod 32 is secured may be provided with sets of bore distributed around a common pitch circle at small intervals to enable the rod 32 to be located in a variety of positions.

Figure 4:
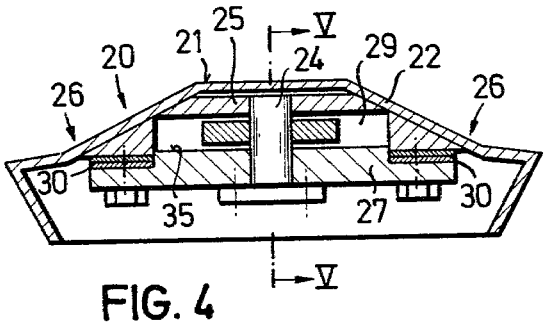
FIG. 4 is a sectional end view of a modified part of the shield apparatus embodying another form for the drive members and corresponding to FIG. 2.
Figure 5:
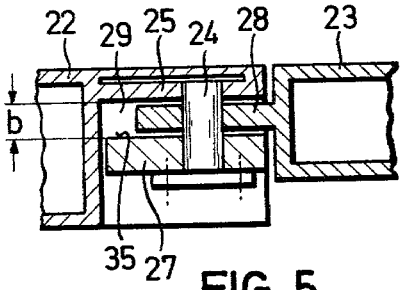
FIG. 5 is a sectional side view of the modified part of the shield apparatus, the view being taken along the line V—V of FIG. 4.

FIGS. 4 and 5 depict a further embodiment of an adjustable connection between the front and rear parts of one of the shield drive members. In these Figures, the composite drive member is designated 20, the front part of the drive member 20 is designated 22 and the rear part is designated 23. In contrast to the curvilinear outer profile (19) of the drive member 4 depicted in FIG. 2, the drive member 20 of the modified construction has a roof-like profile 21, as shown in FIG. 4. The connection between the parts 22,23 is established by way of a pivot pin 24 extending generally radially perpendicularly to the tunnel axis. The pin 24 is supported by a reinforcement web 25 welded to inside of the part 22 and extends through a plate 27 affixed to the part 22 with the aid of fixing means, such as screws or bolts indicated by reference numeral 26. A flange of the pin 24 abuts the inner face of the plate 27. A projection 28 of the rear part 23 of the drive member 20 extends between the web 25 and the plate 27 and receives the pin 24 within a bore or aperture.

As shown in FIG. 5, the projection 28 locates in a gap or recess 29 between the web 25 and the plate 17 with a certain clearance. One or more spacers 30 inserted between the contact faces of the plate 27 and the part 22 enable the width 'b' of the recess 29 to be altered. The face 35 of the plate 27 forms a stop surface for the projection 28, which is urged against the face 35 by the pressure of the tunnel wall. During operation, the connections between the front and rear parts 22,23 of the drive members 20 can be adjusted by fitting or removing the spacers 30 to thereby displace the stop face 35 and bring the external surfaces of the parts 22,23 into alignment in an otherwise analogous manner to the first embodiment. A relatively large clearance in the recess 29 of the connection between the parts 22,23 of each drive member 20 is not disadvantageous but, if desired, additional spacers can be fitted between the inner face of the web 25 and the outer face of the projection 28. It is also possible to provide the projection (28) on the front part 22 and the recess 29 and associated adjustment means (26,27,30) on the rear part 23.

I claim:

1. In or for a drive shield for tunnelling, a composite drive member with elongate front and rear parts collectively displaceable longitudinally in the driving direction, connection means between the rear end of the front part and the front end of the rear part permitting relative pivotal motion between said parts, the connection means being provided with adjustable means enabling the parts to be adjusted additionally relatively to one another at the connection means and in a direction generally transversally to the tunnel wall.

2. In or for shield apparatus for driving tunnels or other excavations, a composite displaceable drive member with elongate front and rear parts pivotably connected to one another by an intermediate connection device provided with additional adjustment means to enable relative displacement between the parts as a whole, additional to the pivotal motion, thereby to permit the outer surfaces of the parts to be positionally displaced and adjusted, one relative to the other.

3. A drive member according to claim 1, wherein said connection means includes an eccentric element which serves to pivotably connect the front and rear parts and which can be rotated to effect said adjustment.

4. A drive member according to claim 3, wherein the eccentric element takes the form of a rotatable spindle with radially offset portions respectively located to the rear and front ends of the front and rear parts.

5. A drive member according to claim 4, wherein the spindle has concentric outer portions located to spaced webs of the rear end of the front part and a central eccentric portion located to a web of the front end of the rear part.

6. A drive member according to claim 1, and further comprising detachable locking means for selectively disabling the transverse adjustment of the connection means.

7. A drive member according to claim 4, and further comprising detachable locking means for locking the spindle in a set rotational position once the parts have been transversely adjusted.

8. A drive member according to claim 1, wherein the adjustment means comprises a rotatable eccentric element.

9. A drive member according to claim 1, wherein the connection means includes a pin extending transversally to the tunnel wall and connecting a projection of one of the parts to the other part, and spacers for adjusting the position of the projection.

10. A drive member according to claim 9, wherein the projection engages in a recess defined within the other part and a plate is adjustably secured to the other part with means, including said spacers, the plate having a stop face engageable with the projection.

11. A drive member according to claim 1, wherein the rear part has a projection at the front end extending into a recess within the rear end of the front part and the adjustable means includes spacers usable to alter the size of the recess.

12. A drive member according to claim 1, wherein the connection means permits the parts to pivot about an axis generally tangential to a circle described from the tunnel axis.

13. A drive member according to claim 1, wherein the connection means permits the parts to pivot about an axis generally radial to the tunnel axis.

14. In or for a drive shield for tunnelling, a composite drive member with elongate front and rear parts collectively displaceable longitudinally in the driving direction, connection means connecting the front and rear parts together for pivoting and additional adjustment means enabling the parts to be bodily displaced for adjustment purposes generally radially of the tunnel axis.

15. Shield apparatus for driving tunnels or the like; said apparatus comprising a plurality of elongate drive members, frame means supporting the drive members in side-by-side relationship for displacement in the driving direction and ram means for advancing the drive members relative to the frame means in the driving direction, wherein each drive member is composed of elongate front and rear parts and a connecting device interconnecting the front and rear parts at adjacent end regions thereof to permit the parts to be advanced collectively together and adjustment means enabling the parts to be positionally adjusted at their interconnection additionally transversally of the driving direction.

* * * * *